US005483931A

United States Patent [19]

Stoll et al.

[11] Patent Number: 5,483,931

[45] Date of Patent: Jan. 16, 1996

[54] DRIVE DEVICE ESPECIALLY FOR A TRIMMER

[75] Inventors: Gerhard Stoll, Winnenden; Helmut Schlessmann, Waiblingen, both of Germany

[73] Assignee: Andreas Stihl, Waiblingen, Germany

[21] Appl. No.: 268,855

[22] Filed: Jun. 30, 1994

[30] Foreign Application Priority Data

Jul. 1, 1993 [DE] Germany ..... 43 21 862.8

[51] Int. Cl.[6] ..... F02N 3/02

[52] U.S. Cl. ..... 123/185.3

[58] Field of Search ..... 123/185.2, 185.3, 123/185.4, 195 A, 195 E

[56] References Cited

U.S. PATENT DOCUMENTS

| | | | |
|---|---|---|---|
| 2,564,787 | 8/1951 | Mack | 123/185.3 |
| 2,742,887 | 4/1956 | Ade et al. | 123/185.3 |
| 3,375,814 | 4/1968 | Hamman | 123/185.2 |
| 3,814,073 | 6/1974 | Nakatani | 123/185.2 |
| 4,928,643 | 5/1990 | Kampichler et al. | 123/185.3 |
| 5,329,896 | 7/1994 | Everts | 123/185.3 |

FOREIGN PATENT DOCUMENTS 0320576 6/1989 European Pat. Off. .

*Primary Examiner*—Andrew M. Dolinar
*Attorney, Agent, or Firm*—Robert W. Becker & Associates

[57] ABSTRACT

A drive device has a housing and an internal combustion engine positioned in the housing. The engine has a crankshaft. A cable starter with a cable and a cable reel for receiving the cable is provided. The cable has a handle at its free end. A cable guide sleeve through which the cable is guided is provided. The crankshaft extends through the cable starter. A clutch with a clutch casing and a support for the cable starter are provided. The support is arranged between the housing and the clutch casing. The support has radially extending arms whereby one of the arms has a securing device for the cable guide sleeve. The securing device has a securing connection selected from the group consisting of a snap connection, a catch connection, and a clip connection.

17 Claims, 7 Drawing Sheets

DRIVE DEVICE ESPECIALLY FOR A TRIMMER

BACKGROUND OF THE INVENTION

The present invention relates to a drive device, especially for a trimmer or cutter, having an internal combustion engine arranged in a housing. The drive device further comprises a cable starter (rewind starter) and a clutch received in a clutch casing whereby a support for supporting the cable starter is positioned between the housing of the internal combustion engine and the clutch casing and wherein the crankshaft of the internal combustion engine extends through the cable starter. The cable starter comprises a cable reel with a cable wound thereon whereby the free end of the cable has a handle connected thereto.

From European document 0 320 576 a drive device for portable working devices is known in which an internal combustion engine is arranged within a housing. The housing of the internal combustion engine together with a cable starter and a clutch casing are combined to form a constructive unit. The cable starter is designed such that it can be inserted as a pre-mounted unit during assembly of the drive device and can be exchanged, if a repair is required, as a pre-mounted unit. In the known arrangement it is however necessary to provide within the housing of the cable starter an opening with a wear-resistant guide and to thread the cable through this opening of the housing. This arrangement is furthermore cumbersome when mounting the cable reel without idle path of the return spring.

It is therefore an object of the present invention to improve a drive device of the aforementioned kind such that a cost-effective manufacture and a simple assembly are provided.

SUMMARY OF THE INVENTION

The drive device according to the present invention is primarily characterized by:

A housing;

An internal combustion engine positioned in the housing, the engine comprising a crankshaft;

A cable starter comprising a cable and a cable reel for receiving the cable, the cable having at a free end thereof a handle;

A cable guide sleeve through which the cable is guided;

The crankshaft extending through the cable starter;

A clutch with a clutch casing;

A support for the cable starter, the support arranged between the housing and the clutch casing;

The support having radially extending arms, with one of the arms having a securing device for the cable guide sleeve; and The securing device having a securing connection in the form of a snap connection.

Preferably, the cable guide sleeve has free ends with radial collars. The securing device has a bearing member substantially in the form of a sleeve having a U-shaped cross-section.

Preferably, the bearing member has axial ends with radial flanges.

Advantageously, the snap connection is a securing bracket having a projection for engaging behind the cable guide sleeve.

Expediently, the securing bracket has an arcuate section and the projection is located at a free end of the securing bracket.

In a preferred embodiment of the present invention, the projection has an arc-shaped side facing inwardly relative to the securing bracket. A radius of the arc-shaped side is substantially identical to the radius of the cable guide sleeve.

Preferably, the projection has a side facing outwardly relative to the securing bracket and the side facing outwardly has a guiding slant.

In another embodiment of the present invention, the bearing element has a slot and the securing bracket extends through the slot.

Preferably, the one arm having the securing device for the cable guide sleeve has an angled section and the securing device is arranged at the angled section.

Expediently, the support has four arms positioned at different angular distances from one another.

Advantageously, the support with the arms and the securing device together are in the form of a one-piece injection-molded member.

Expediently, one of the arms has a clamp for fastening an electric cable. Preferably, the clamp has a bracket protecting from a plane of the arm. Advantageously, the bracket has a free end with a projection pointing in a direction toward the plane of the arm.

In yet another embodiment of the present invention the support has a sleeve and the cable reel has a hub positioned on the sleeve such that the cable reel is rotatable on the sleeve. The support further comprises means for axially fixing the cable reel on the sleeve.

Advantageously, the sleeve has a greater axial length than the hub of the cable reel. The means for axially fixing is preferably a radial projection positioned at a free end of the sleeve. The hub advantageously has a safety ring at one axial end which safety ring is engaged by the radial projection when the hub is slipped onto the sleeve.

Preferably, the hub has an outer surface with at least one flank and the crankshaft has a follower rotating with the crankshaft. The follower has at least one radially extending finger. The at least one flank and the at least one finger cooperate with one another in the manner of a slip coupling.

Since the cable guide sleeve is substantially exclusively loaded in the axial direction, an especially expedient embodiment of the invention is as follows: the cable guide sleeve at its free ends is provided with radial collars and the securing device comprises a bearing member that is substantially in the form of a sleeve with a U-shaped cross-section. In order to increase the support surfaces of the bearing member relative to the cable guide sleeve in the axial direction, it is suggested that the bearing member at its axial ends is provided with radial flanges. In order to provide for an easy removal of the cable guide sleeve in case of necessary repairs and also to lower the required force for overcoming the snap connection during mounting, it is suggested that as a snap connection a securing bracket with a projection is provided whereby the projection engages behind the cable guide sleeve. For reasons of elasticity it is expedient that the securing bracket is provided with an arcuate section and that the projection is located at the free end of the securing bracket. In order to keep the force exerted by the cable guide sleeve on the securing bracket at a level as low as possible, it is expedient that the projection is arc-shaped on the side of the securing device facing inwardly whereby the radius of the arc-shaped side corresponds to the radius of the cable guide sleeve. Such an embodiment also counteracts an undesired opening of the securing bracket. For simplifying mounting of the cable guide sleeve within the bearing member, a guiding slant is provided at the exterior side of the projection. In order for the free end of the securing bracket to extend approximately in the direction that corresponds to the mounting direction of the cable guide sleeve within the bearing member, it is suggested that the securing bracket extends through a slot within the mantle surface of the bearing member.

It is advantageous that the securing device is arranged at an angled section of one of the arm of the support such that the cable guide sleeve is received in the direct vicinity of a fastening point of the cable starter. In order to ensure that the fastening points have a uniform arrangement, which may be required when the fastening screws are designed to fasten the clutch casing as well as the cable starter at the housing of the internal combustion engine, it is suggested that the support is provided with four arms which are arranged at different angular distances relative to one another. The support is preferably in the form of a one-piece injection molded part comprising the arms and the securing device. In order to avoid additional fastening means for an electric cable, it is advantageous to provide at one of the arms a clamp for fastening the cable. This clamp is expediently in the form of a bracket which is formed so as to project from the plane of the arm. This makes parts to be mounted separately obsolete. In order to counteract an undesired loosening of the cable within the clamp, it is expedient to provide the free ends of the bracket with a projection pointing in the direction toward the plane of the arm.

The cable starter (rewind starter) is designed as a complete pre-mounted unit to be assembled with the drive unit for completing the drive device and is also designed as such as a replacement part. In order to ensure that the cable reel is securely held at the support and that the return spring arranged between these two parts is also securely held, it is expedient that the support is provided with a sleeve on which the cable reel with its hub is rotatably supported and on which means for axially fixing the cable reel are provided. Expediently, the sleeve has a greater axial length than the hub of the cable reel. The means for axially fixing comprises a safety ring provided at one end of the hub of the cable reel and a radial projection at a free end of the sleeve which engages the safety ring.

BRIEF DESCRIPTION OF THE DRAWINGS

The objects and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 through 9.

Figure 1:
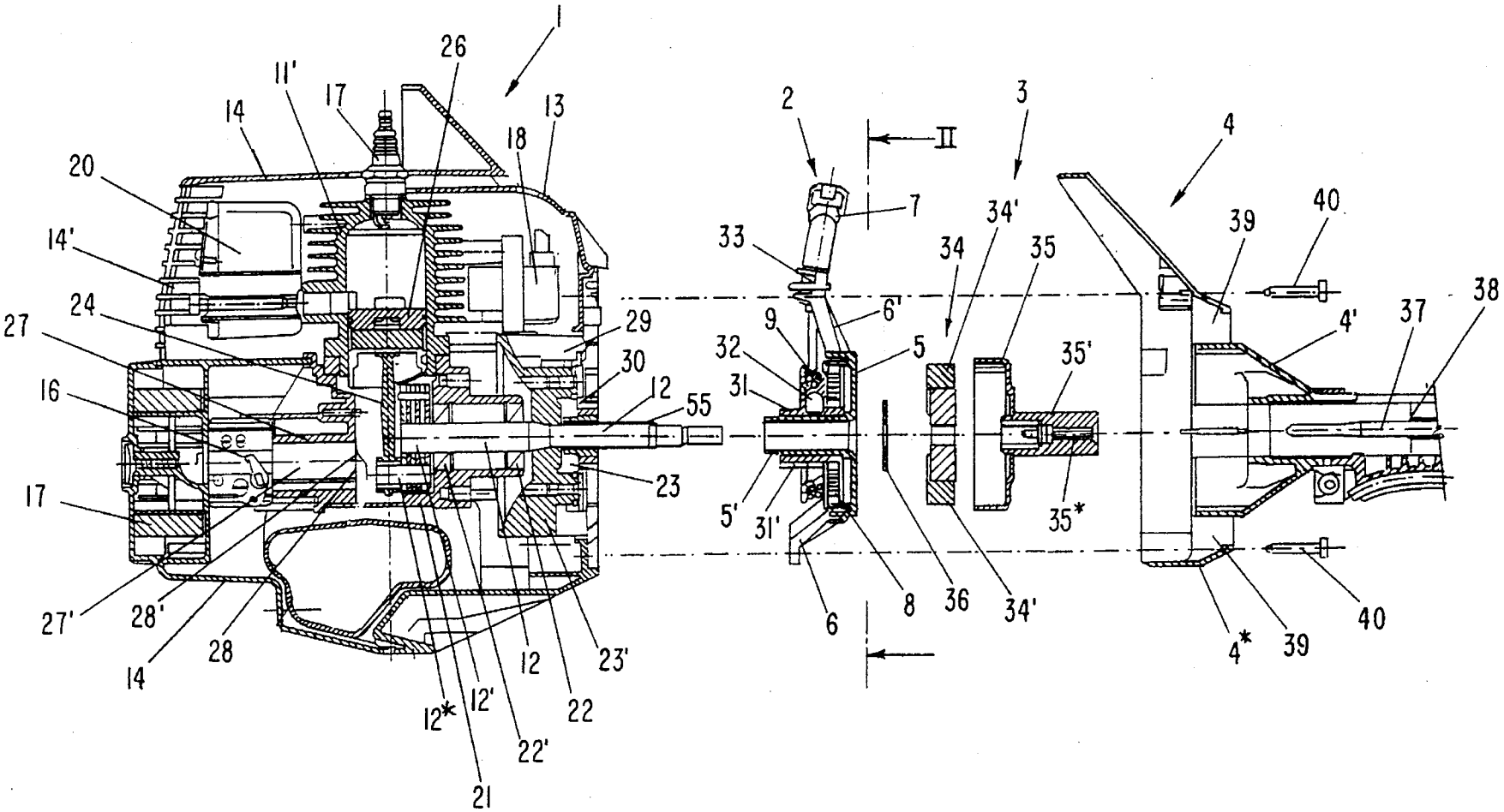
FIG. 1 shows an exploded view of the drive device of a trimmer.

The exploded view represented in FIG. 1 shows essentially the main components: drive unit 1, cable starter 2, and clutch 3 with clutch casing 4. The drive unit 1 is comprised of a two-stroke internal combustion engine 11 contained in housing 10 with a crankshaft 12 supported on one side. Within the housing 10 comprised of two cup-shaped housing parts 13 and 14 the fuel tank 15, the carburetor 16 with air filter 17, a solenoid ignition 18 for a spark plug 19, and a muffler 20 are arranged. The internal combustion engine 11 comprises a crank case 21 in which the crankshaft 12 is supported on two bearings 22, 22'. On the end 12' of the crankshaft 12 that extends into the crank chamber 24 a crank 12* is connected that is engaged by a connecting rod 25 that is connected, in turn, with the piston 26 guided within the cylinder 11'. The crankcase 21 is provided with a diaphragm support 27 on the side adjacent to the carburetor 16, whereby the diaphragm support 27 is comprised of a plastic material and has a suction line 27'. The diaphragm support 27 connects the carburetor 16 with the crank chamber 24 whereby at the end of the suction line 27' a diaphragm 28 with a limiter 28' is arranged.

External to the crank case 21 a flywheel 23 is fixedly connected to the crankshaft 12 and serves simultaneously as a fan. The outer circumference of the flywheel 23 is provided with fan blades 29 in order to provide the cylinder 11' with cooling air. The cooling air flows along the cooling ribs formed at the cylinder 11' and along the muffler 20 to exit through the air slots 14' within the housing part 14. The flywheel 23 has a recess 23' which forms an annular chamber between the crankshaft 12 and the flywheel 23. Radially arranged fingers 30 extend into this annular chamber which are provided for the temporary engagement of flanks 31' of the hub 31 of the cable starter 2.

The cable starter 2 comprises arms 6, 6' connected to a support 5 having a central sleeve 5' on which the hub 31 of the cable reel 32 is rotatably supported. Between the cable reel 32 and the support 5 a coil spring (return spring) 8 is provided for returning the cable starter 2 into its initial position, respectively, for the automatic reeling of the cable 9 onto the cable reel 32. One of the arms 6' supports a cable guide sleeve 33 through which the cable 9 extends to a handle 7 that is connected to the free end of the cable 9.

The clutch 3 comprises a drive part 34 with shoes 34' that are spreadable by centrifugal force and a cup-shaped clutch drum 35 which encloses at a small radial distance the drive part 34. A disk 36 serves for axially positioning the drive part 34 on the forward end of the crankshaft 12 whereby the disk 36 rests at the forward end of a spacer sleeve 55 arranged on the crankshaft 12 and penetrating the cable starter 2. The clutch drum 35 has a hub 35' that receives within a central opening 35* the end of a drive shaft 37 which extends to a cutting tool of the trimmer that is not represented in the drawling. A support tube 35 surrounding the drive shaft 37 is connected to the clutch casing 4 which is comprised of a bell-shaped center part 4' and a casing mantle 4*. Between the center part 4' and the casing mantle 4* openings 39 are formed which allow the introduction of cooling air. For fastening the clutch casing 4 and the cable starter 2 the same screws 40 which are to be threaded into corresponding threaded bores within the housing part 13 are provided so that the screw holes 6' in the arms 6, 6' and in the clutch casing 4 are aligned with one another.

Figure 2:
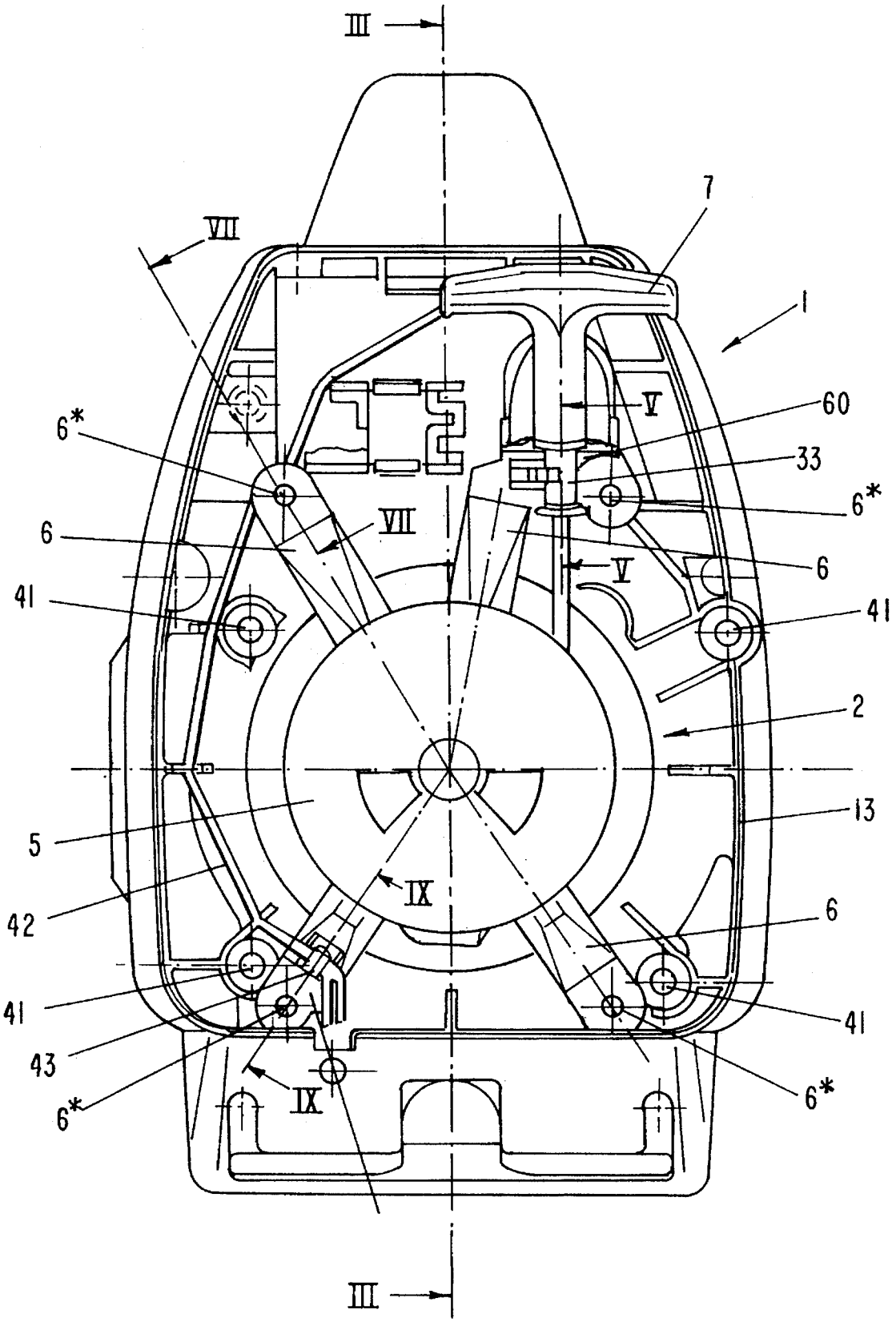
FIG. 2 shows a view in direction of arrows II in FIG. 1.

In FIG. 2 the housing 1 is shown with the cable starter 2 connected to the housing part 13. It is illustrated that the support 5 of the cable starter 2 is supported by four arms 6, 6' and that these arms 6, 6' are arranged at different angular distances relative to one another. While the arms 6 are straight and are provided with a fastening opening 6*, the arm 6' is angular. At the angled section 60 of the arm 6' the cable guide sleeve 33 is located. With this angled section 60 it is achieved that the cable guide sleeve 33 is positioned in direct vicinity of the fastening point of the arm 6' at the housing part 13. In the drawing the angled section 60 of the arm 6' is arranged between the fastening point and the radial portion of the arm 6', however, it is also possible to position the arm 6' such that it is oriented directly toward the fastening point and that the angled section 60 begins there. The cable 9 extends through the cable guide sleeve 33 and is connected to the handle 7. The fastening screws for connecting the housing parts 13 and 14 are indicated at reference numeral 41 and are positioned in areas not covered by the arms 6, 6'. At the lower arm 6 a clamp 43 for securing a cable 42 is provided. For turning off the internal combustion engines, the solenoid switch 18 is shortened via the cable 42 so that the spark plug 19 does not generate ignition sparks.

Figure 3:
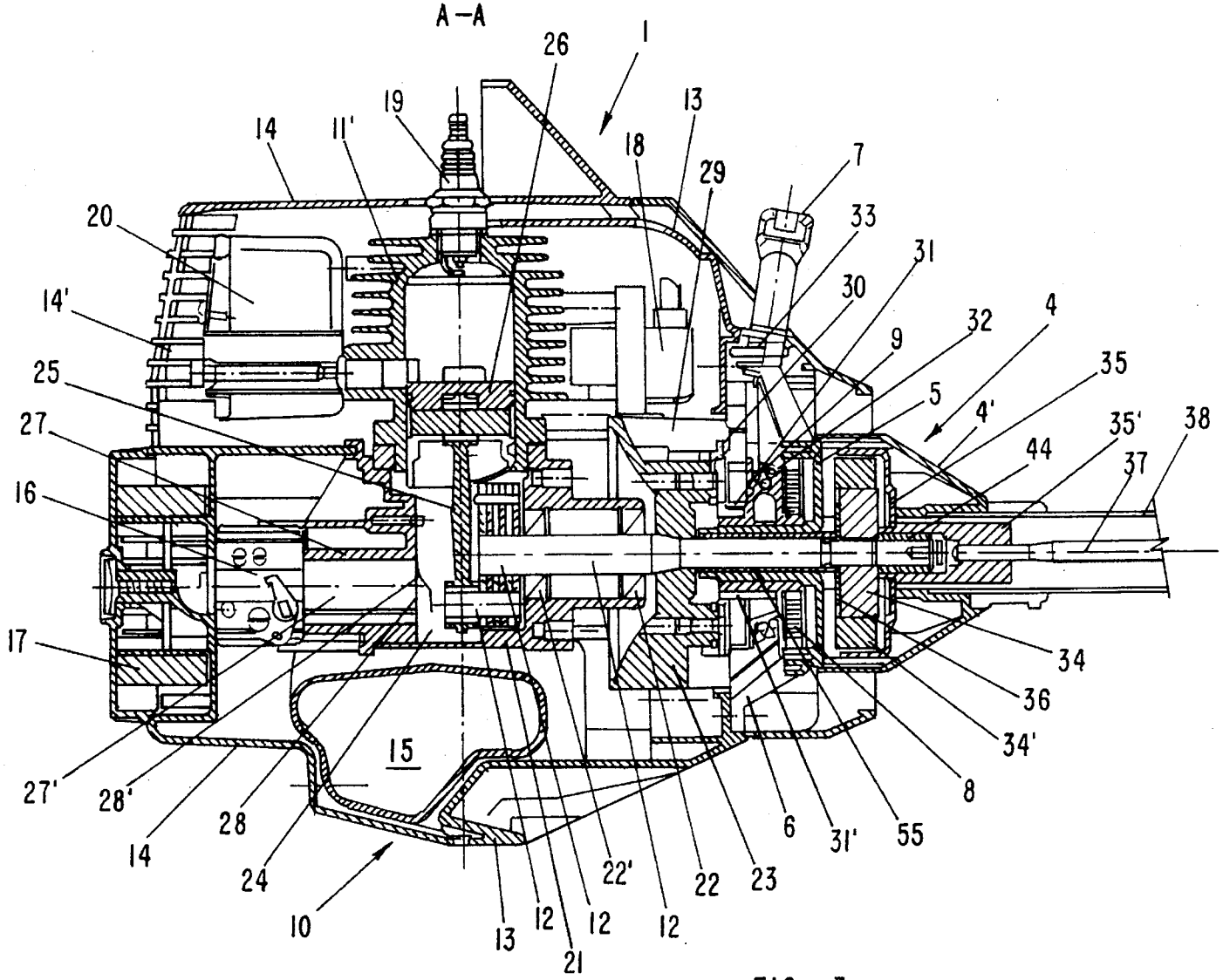
FIG. 3 shows a section along line III—III in FIG. 2.

FIG. 3 shows a section along the line III—III in FIG. 2. This view corresponds to the assembled state of the individual components represented in FIG. 1. For identical parts the same reference numerals as in FIGS. 1 and 2 are used so that no further description is necessary of these parts. For the assembly of the individual components the premounted complete cable starter 2 is first slipped onto the crankshaft 12 whereby the hub 31 is positioned in the area of the radially movable fingers 30. After mounting of the support 5, i.e., of the cable starter 2, on the crankshaft 12, the disk 36 is positioned on the free end of the crankshaft 12. Due to its inner diameter the disk 36 abuts at the sleeve positioned on the crankshaft 12. Subsequently, the drive part 34 of the clutch is pressed onto the crankshaft 12. The clutch drum 35 is supported on the forward end of the crankshaft 12 with an intermediate sleeve 44 serving as a friction bearing between the crankshaft 12 and the hub 35'. Now the clutch casing 4 can be slipped over the clutch and can be connected to the housing part 13. The drive shaft 37 with its forward end is inserted into the opening 35* and due to the profiles of opening and free end of the drive shaft 37 a fast connection is achieved. With the screws 40 the fastening of the support 5 and the clutch casing 4 at the housing is performed simultaneously.

Figure 4:
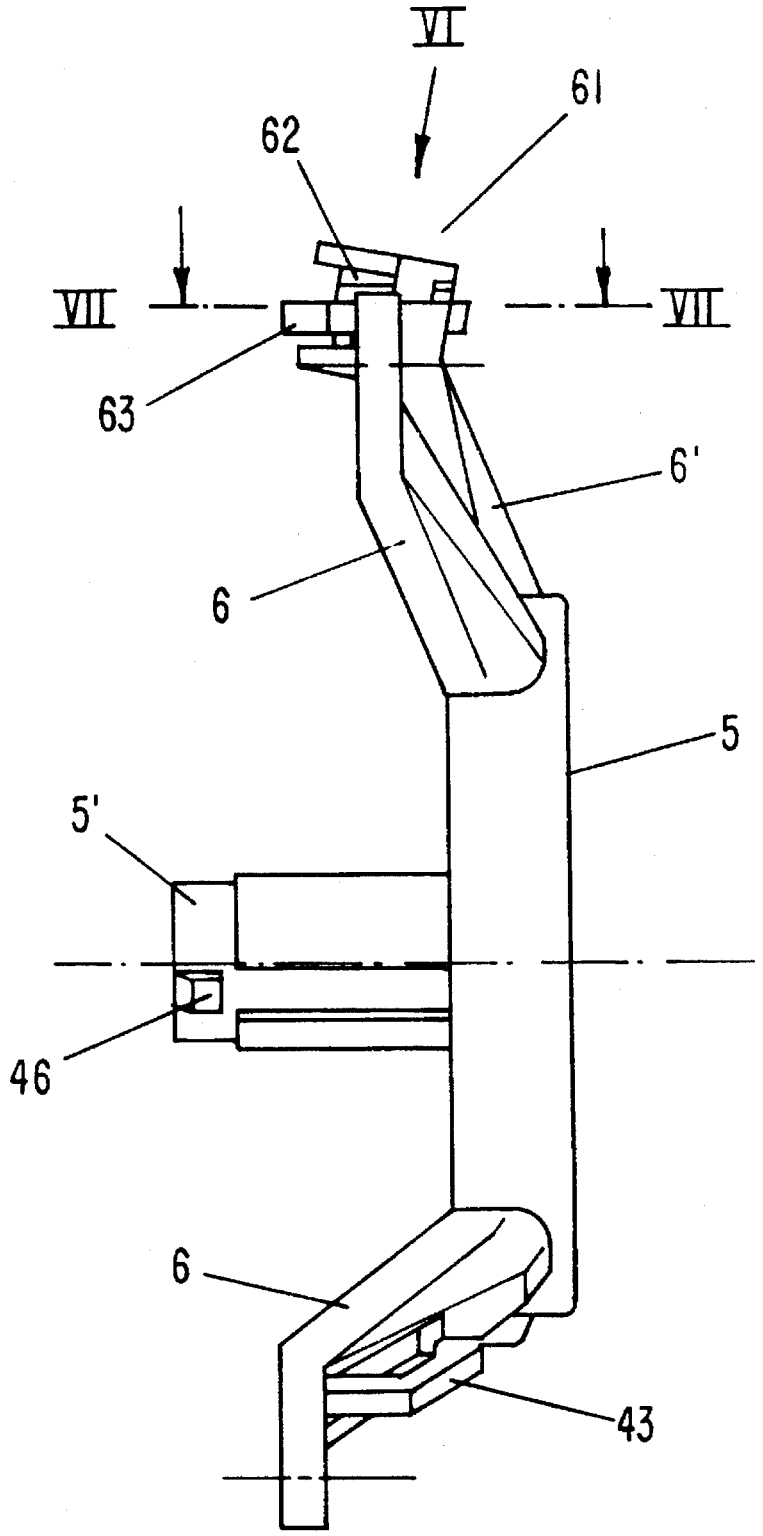
FIG. 4 shows a view of the support of the cable starter in an enlarged representation.

FIG. 4 shows the support 5 of the cable starter in an enlarged representation. At the free end of the sleeve 5' a radial projection 46 is provided which in cooperation with a safety ring serves for axially fixing the cable reel 32 on the sleeve 5'. The support 5 is provided with clamp 43 located at the lower arm 6 which clamp 43 secures the cable 42 shown in FIG. 2. In FIG. 4 the upwardly extending arms 6 and 6' of the support 5 are shown whereby the arm 6' is provided with the securing device 61 for the cable guide sleeve. The securing device 61 comprises a bearing member 62 and a securing bracket 63 which parts 62, 63 will be explained in the following in greater detail with the aid of FIGS. 6 and 7.

Figure 5:
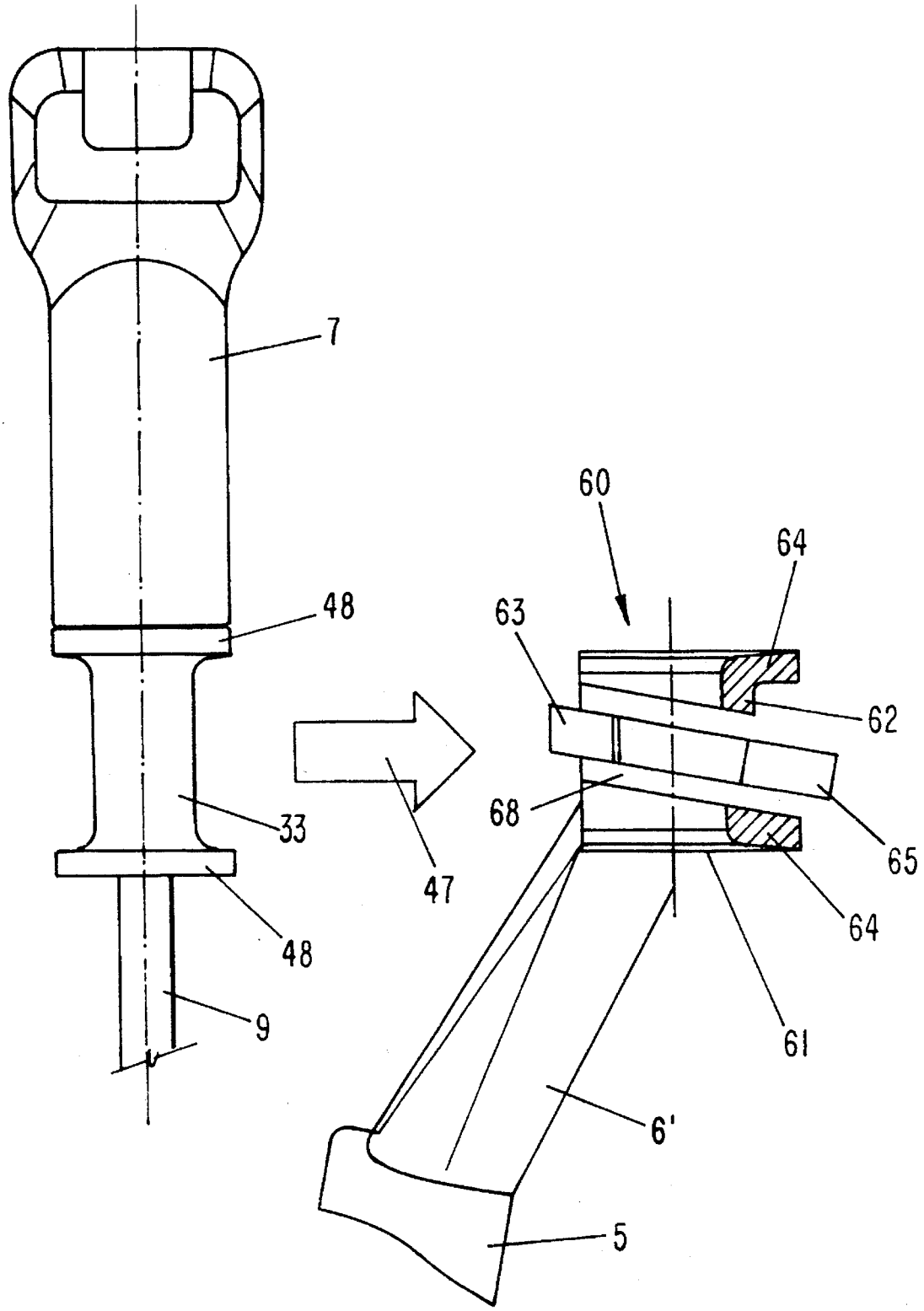
FIG. 5 shows how the cable guide sleeve is received in the securing device in a view according to arrows V—V in FIG. 2 in an enlarged representation.
Figure 6:
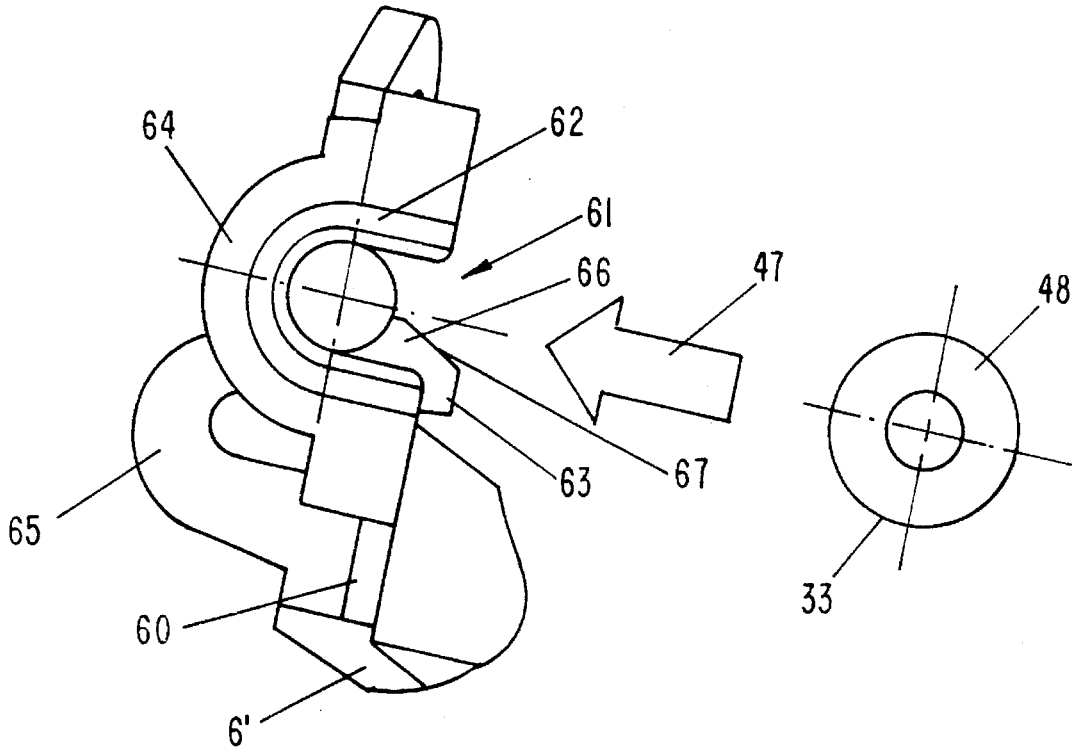
FIG. 6 shows a view in direction of arrow VI in FIG. 4.
Figure 7:
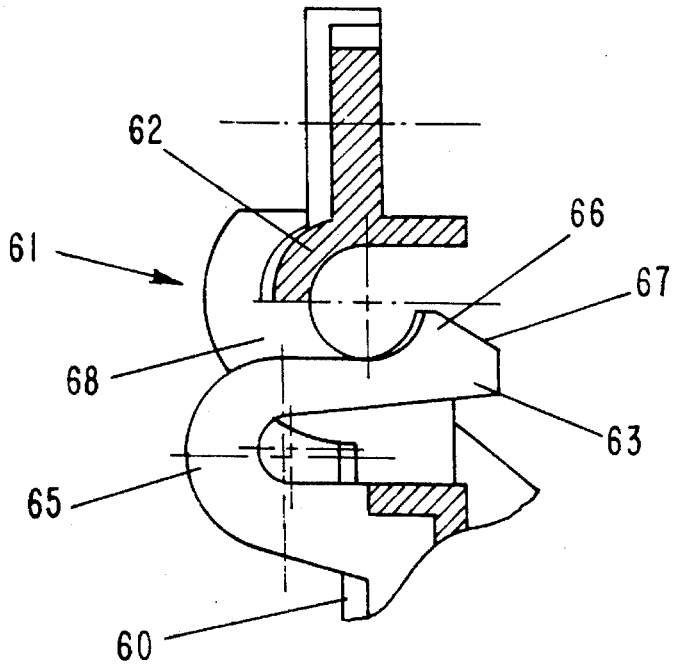
FIG. 7 shows a section along the line VII—VII in FIG. 4.

FIG. 5 shows in an enlarged representation a view in the direction of arrows V—V in FIG. 2. The arm 6' formed on the holder 5 is provided with an angled section 60 which is embodied as a securing device 61 for the cable guide sleeve 33. The securing device 61 is comprised of a bearing element 62 and a securing bracket 63 whereby the bearing element 62 according to the representations in FIGS. 6 and 7 is substantially in the form of a sleeve having a U-shaped cross-section with radial flanges 64 at the free ends. The cable guide sleeve 33, after the handle 7 has been connected to the free end of the cable 9, is inserted in the direction of arrow 47 into the securing device 61 so that the radial collars 48 at the free ends of the cable guide sleeve 33 abut at the radial flanges 64 and thereby provide a fixation in the axial (cable pulling) direction. When the cable guide sleeve 33 is received in the bearing member 62, the securing bracket 63 which is spring-elastic, surrounds a portion of the circumference of the sleeve 33 and thus secures the sleeve 33 within the securing device 61. The bearing member 62 at its mantle surface is provided with a slanted slot 68 the insertion depth of which extends substantially to the center of the bearing member 62, as can be seen in FIG. 7, so that the securing device 61 can be manufactured as a one-piece injection-molded member that is easily removable from the mold.

The view represented in FIG. 6 in direction of arrow VI and the section represented in FIG. 7 along the line VII—VII (see FIG. 4) clearly show the U-shaped cross-section of the bearing member 62. During introduction of the cable guide sleeve 33 into the securing device 61, the securing bracket 63 that is elastic or springy due to the arcuate section 65, is moved out of the cross-sectional area of the U-shape of the bearing member 62. The securing bracket 63 at its free end has a projection 66 for engaging the cable guide sleeve 33. The projection 66 is arc-shaped on the inner side of the securing device 61 whereby the radius corresponds to the radius of the cable guide sleeve 33. At the outer side the projection 66 is provided with a guiding slant 67 which serves to facilitate mounting.

Due to the described embodiment of the cable starter 2 it is possible to preassemble the starter in a simple manner to a complete unit without the cable 9 having to be threaded through the housing. The cable 9 is wound onto the cable reel 32, the cable guide sleeve 33 is then slipped onto the free end of the cable 9, and subsequently the handle 7 is connected to the free end of the cable 9. The cable reel 32 with the completely wound cable 9 is then slipped onto the sleeve 5' with a coil spring 8 being interposed. Subsequently, the safety ring is mounted which is engaged by the radial projection 46. The cable reel 32 is then rotated until no further idle path of the return spring in the rotational direction is present. Subsequently, the cable guide sleeve 33 is inserted into the securing device 61 by inserting it into the bearing member 62 in the direction of arrow 47 (see FIGS. 5 and 6). The cable guide sleeve 33 contacts the guide slant 67 so that the projection 66 of the securing bracket 63 is displaced laterally. As soon as the cable guide sleeve 133 is completely received in the bearing member 62, the securing bracket 63 elastically returns into its initial position and engages with the projection 66 the cable guide sleeve 33.

Figure 8:
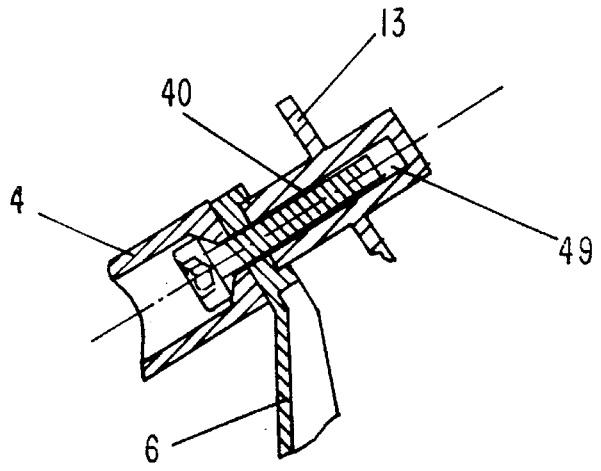
FIG. 8 shows a section along the line VIII—VIII in FIG. 2.

In FIG. 8 a section along the line VIII—VIII of FIG. 2 is represented from which it can be taken that the screws 40 simultaneously serve for fastening the arms 6 of the cable starter and the clutch casing 4 at the housing part 13 whereby the screws 40 threaded into the bore 49 of the housing part 13 clamp the arm 6 between the clutch casing 4 in the housing part 13.

Figure 9:
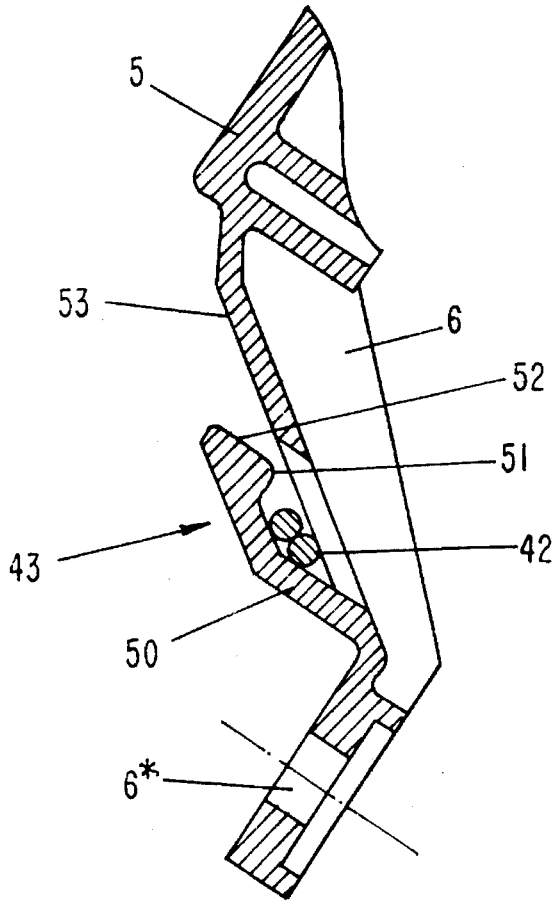
FIG. 9 shows a section along the line IX—IX in FIG. 2.

FIG. 9 shows a section of the arm 6 along the line IX—IX in FIG. 2 without the fastening screw. This arm 6 is provided with a clamp 43 in an area between the opening 6* for the fastening screw and the support 5. This clamp 43 is in the form of a bracket 50 projecting from the plane 53 of the arm 6. At its free end the bracket 50 is provided with a projection 51 pointing in the direction toward the plane of the arm 6 whereby this projection 51 is provided at the outer side with a slant 52. The clamp 43 serves for fastening the cable 42 represented in FIG. 2 such that this cable 42 is secured between the bracket 50 and the arm 6 whereby the projection 51 prevents the cable from sliding out of the bracket 50.

The present invention is, of course, in no way restricted to the specific disclosure of the specification and drawings, but also encompasses any modifications within the scope of the appended claims.

What is claimed is:

1. A drive device comprising:

a housing;

an internal combustion engine positioned in said housing, said engine comprising a crankshaft;

a cable starter comprising a cable and a cable reel for receiving said cable, said cable having at a free end thereof a handle;

a cable guide sleeve through which said cable is guided;

said crankshaft extending through said cable starter;

a clutch with a clutch casing;

a support for said cable starter, said support arranged between said housing and said clutch casing;

said support having radially extending arms, with one of said arms having a securing device for said cable guide sleeve; and said securing device having a securing connection in the form of a snap connection.

2. A drive device according to claim 1, wherein said cable guide sleeve has free ends with radial collars and wherein said securing device has a bearing member substantially in the form of a sleeve having a U-shaped cross-section.

3. A drive device according to claim 2, wherein said bearing member has axial ends with radial flanges.

4. A drive device according to claim 2, wherein said snap connection is a securing bracket having a projection for engaging behind said cable guide sleeve.

5. A drive device according to claim 4, wherein said securing bracket has an arcuate section and wherein said projection is located at a free end of said securing bracket.

6. A drive device according to claim 4, wherein said projection has an arc-shaped side facing inwardly relative to said securing bracket, and wherein a radius of said arc-shaped side is substantially identical to a radius of said cable guide sleeve.

7. A drive device according to claim 4, wherein said projection has a side facing outwardly relative to said securing bracket, and wherein said side facing outwardly has a guiding slant.

8. A drive device according to claim 4, wherein said bearing member has a slot and wherein said securing bracket extends through said slot.

9. A drive device according to claim 1, wherein said one of said arms having said securing device for said cable guide sleeve has an angled section and wherein said securing device is arranged at said angled section.

10. A drive device according to claim 1, wherein said support has four said arms positioned at different angular distances from one another.

11. A drive device according to claim 1, wherein said support with said arms and said securing device together are in the form of a one-piece injection-molded member.

12. A drive device according to claim 1, wherein one of said arms has a clamp for fastening an electric cable.

13. A drive device according to claim 12, wherein said clamp is a bracket projecting from a plane of said one of said arms.

14. A drive device according to claim 13, wherein said bracket has a free end with a projection pointing in a direction toward said plane of said one of said arms.

15. A drive device according to claim 1, wherein said support has a sleeve and wherein said cable reel has a hub positioned on said sleeve such that said cable reel is rotatable on said sleeve, said support further comprising means for axially fixing said cable reel on said sleeve.

16. A drive device according to claim 15, wherein:

said sleeve has a greater axial length than said hub of said cable reel;

said means for axially fixing is a radial projection positioned at a free end of said sleeve; and said hub has a safety ring at one axial end which safety ring is engaged by said radial projection when said hub is slipped onto said sleeve.

17. A drive device according to claim 15, wherein:

said hub has an outer surface with at least one flank;

said crankshaft has a follower rotating with said crankshaft, said follower having at least one radially extending finger; and said at least one flank and said at least one finger cooperating with one another in the manner of a slip coupling.

* * * * *